United States Patent [19]

Svoboda

[11] Patent Number: 4,550,666

[45] Date of Patent: Nov. 5, 1985

[54] EQUIPMENT STAND

[75] Inventor: Rudolf Svoboda, Ottokar-Kernstock-Str. 17, A 3100, St. Pölten, Austria

[73] Assignee: Firma Svoboda Entwicklung AG, St. Pölten, Austria

[21] Appl. No.: 493,645

[22] Filed: May 11, 1983

[30] Foreign Application Priority Data

May 11, 1982 [AT] Austria ..... 1847/82

[51] Int. Cl.[4] ..... A47B 57/00

[52] U.S. Cl. ..... 108/96; 108/9; 108/145

[58] Field of Search ..... 108/96, 144, 145, 9, 108/10

[56] References Cited

U.S. PATENT DOCUMENTS

| | | | |
|---|---|---|---|
| 399,220 | 3/1889 | Timroth | 108/145 X |
| 1,375,867 | 4/1921 | Thompson | 108/9 X |
| 1,606,101 | 11/1926 | Russell | 108/96 X |
| 2,160,289 | 5/1939 | Sagner | 108/96 |
| 2,356,924 | 8/1944 | Froelich | 108/144 X |
| 4,226,486 | 10/1980 | Roberts et al. | 108/96 X |
| 4,334,482 | 6/1982 | Bolduc | 108/96 X |
| 4,365,561 | 12/1982 | Tellier et al. | 108/7 |
| 4,384,532 | 5/1983 | Staff | 108/96 X |

FOREIGN PATENT DOCUMENTS

| | | | |
|---|---|---|---|
| 2320344 | 11/1974 | Fed. Rep. of Germany | 108/96 |
| 2530603 | 1/1977 | Fed. Rep. of Germany | 108/10 |
| 2836655 | 10/1979 | Fed. Rep. of Germany . | |
| 1509192 | 5/1978 | United Kingdom | 108/96 |

*Primary Examiner*—Philip C. Kannan

*Attorney, Agent, or Firm*—Karl F. Ross; Herbert Dubno

[57] ABSTRACT

A data-processor stand has a platform for the display screen which is mounted on a vertically adjustable upright from a base while the keyboard can be placed upon a second platform connected to the support formed at the underside of the first platform by a linkage whose link member can be vertically adjusted by a screw spindle.

18 Claims, 16 Drawing Figures

EQUIPMENT STAND

FIELD OF THE INVENTION

The present invention relates to an equipment stand and, more particularly, to a height-adjustable, two-platform equipment stand which can be used, for example to support two associated pieces of equipment for simultaneous use by an operator. More particularly, the invention relates to a stand for data-processing equipment having a platform for the monitor of display unit and another platform for a keyboard or the like, both carried by a support, so that the equipment can be positioned to suit the needs of an operator.

BACKGROUND OF THE INVENTION

In the use of data processing equipment and modern office machinery, computer facilities and the like, it has been found to be desirable to provide at least two platforms on a stand or support for the equipment which can be positioned at different levels and which can present the individual pieces of equipment at the appropriate levels to the operator. For example, such equipment can include a data processor which has, inter alia a monitor having a displayed screen upon which the text is displayed, e.g. via a cathode raytube, and a keyboard which can be connected to the monitor and/or to a computer housing connected to the monitor.

It has been found to be advantageous to provide these units of the instrument at different levels and with various inclinations to prevent tiring of the operator and to enable the operator to utilize the equipment most efficiently.

In particular, the screen can be located somewhat higher than the keyboard and, indeed, the keyboard can be oriented in one direction while the screen faces in another for optimum use as may be desired.

In the past, the two platforms have been connected via separate adjusting devices for controlling the height directly and individually with the support or base of the stand. This has created the need for two-post or frame structures, has complicated the design of the stand and inordinately increased its cost and, in general, has created difficulties with positioning and adjusting the various parts mutually and individually.

OBJECTS OF THE INVENTION

It is, therefore, the principal object of the present invention to provide an improved two-platform stand which can avoid the disadvantages enumerated above.

Another object of this invention is to provide a system for mutually and independently adjusting the heights of two platforms adapted to receive, for example, the display screen and keyboard of a data processing unit, which simplifies the construction of the post or carrying arrangements for these platforms.

Yet another object of the invention is to provide an adjustable height stand for data processing equipment including display and keyboard facilities with increased versatility.

SUMMARY OF THE INVENTION

These objects and others which will become apparent hereinafter are attained, in accordance with the present invention, in an equipment stand for the purposes described, namely, to provide separate platforms for a monitor or display screen and the keyboard of a word processor or computer, which comprises a support having a based adapted to rest upon the floor, a first platform on the support, means for varying the height of this platform relative to the base, and a second adjustable-height and/or tiltable platform connected to said support by an articulated linkage enabling the position of the second platform to be adjusted at least as to height, relative to the first platform.

According to the invention, therefore, the second height-adjustable and/or tilt-adjustable platform can either be connected to the first platform or to the structure connecting the first platform to the base.

The invention is also applicable wherever two platforms of different heights and adjustability of these heights may be desired, e.g. for writing platforms and typewriter platform combinations, or the like.

Advantageously, the linkage is provided with a screw spindle for adjusting the position of at least one link member. For example, if this link member articulated to the support at one end and to the second platform at another end while passing beneath the first platform, the screw or spindle can be provided beneath this platform to swing the linkage about the pivot formed at the first end and thereby adjust the height of the second platform.

The linkage itself is advantageously formed by a bent U-shaped bar whose free ends are pivotally connected or articulated to the underside of the second platform while the bight from which these arms extend, is articulated to the underside of the first platform.

Naturally, the links can comprise two shanks connected in a torsion-stiff manner, i.e. so that the shanks cannot be twisted one with respect to the other.

Advantageously, the second platform can be adjustably tiltable and, to this end, a pivot may be provided between the second platform and the shanks or arms of the link means, while clamping screws can be provided to lock the second platform in its angular orientation about the axis of the latter pivot.

Naturally, a single arm link means may also be provided, also with means for locking the auxiliary platform in its angular position.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
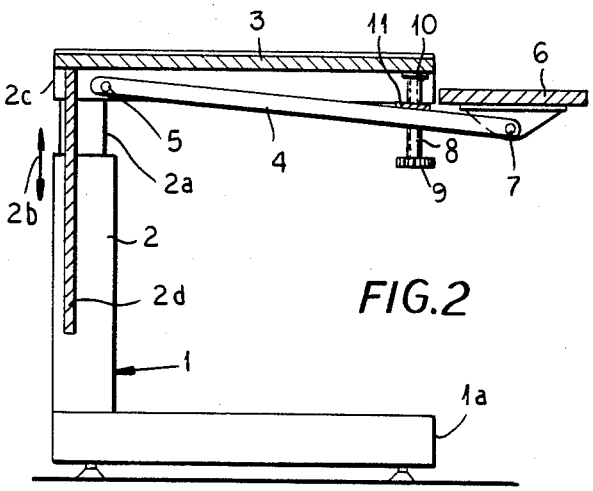
FIG. 2 is a cross sectional view taken along the line II—II of FIG. 1.
Figure 1A:
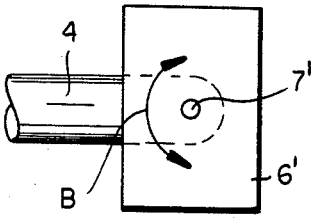
FIG. 1A is a fragmentary plan view illustrating a modification.
Figure 1:
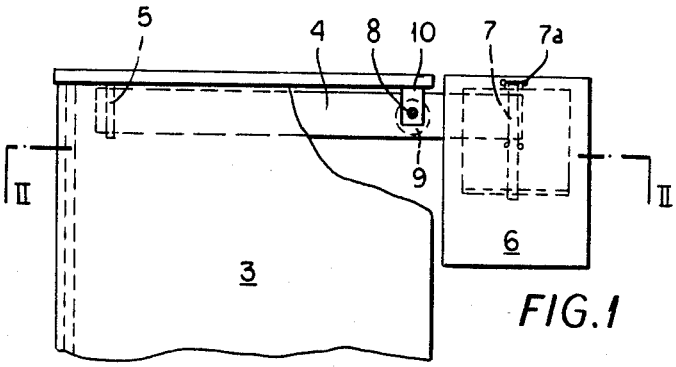
FIG. 1 is a plan view of a data processor stand in accordance with the invention having a large and a small platform.

In FIGS. 1 and 2 there is shown an equipment stand which comprises a support 1 having a base 1*a*, a post 2 affixed to this base and a tubular structure receiving an upright 2*a* which is vertically displaceable on the support as represented by the arrow 2*b* although the means for vertically displacing it has not been illustrated. The upright 2*a* carries, via horizontal beams 2*c*, a first or relatively large platform 3 which can serve to receive a monitor or display screen of a data-processing machine. A downwardly extending apron 2*d* may be affixed to the rear end of the platform 3.

On the underside of this platform 3 which forms part of a support generally represented at 1, there is provided a link 4 having a horizontal pivot axis 5 fixed with respect to the underside of the platform 3 and carrying at its opposite end via a pivot 7, a second relatively small platform 6 which can accommodate a keyboard. Clamping screws, as represented at 7*a* as a butterfly nut, can be provided to lock the platform 6 against the link 4 and thereby adjust the tilt of the keyboard platform 6.

For the vertical adjustment of the keyboard platform 6, a link 4 can be provided with a nut 11, fixed to the link and traversed by a threaded spindle 8 journaled at 10 on the underside of the platform 3 remote from the pivot 5. The spindle 8 can have a handwheel 9 to facilitate its rotation. The nut 11 can be guided in the link 4 for movement longitudinally thereover and can tilt within this link as may be required to enable rotation of the handwheel 9 to displace the spindle 8 and raise or lower the nut 11 and thereby lift or lower the platform 6. In the uppermost position of stepless adjustment of the height of the platform 6 relative to platform 3, the two platforms may be at the same level.

Figure 4:
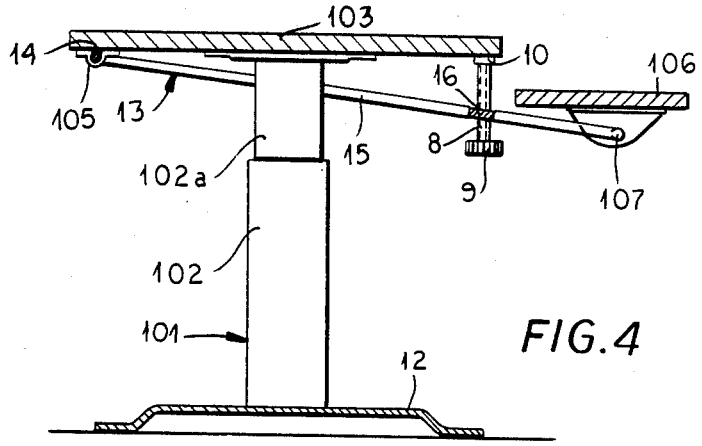
FIG. 4 is a section along the line IV—IV of FIG. 3.
Figure 3:
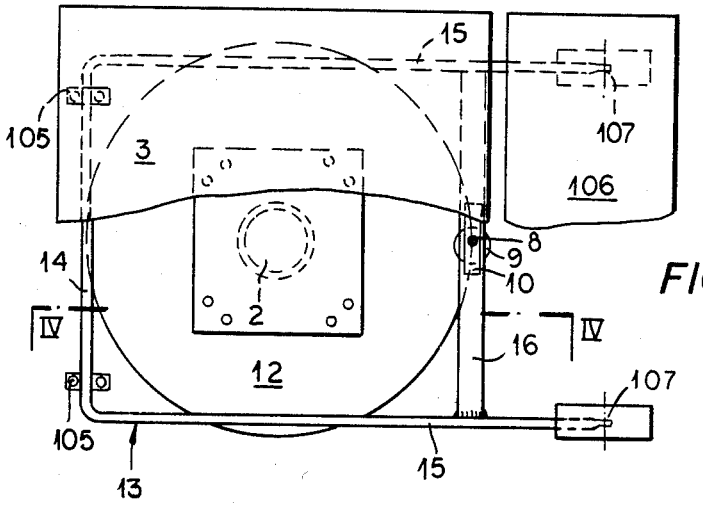
FIG. 3 is a view similar to FIG. 1 illustrating another embodiment of the invention having a U-shaped linkage.

Referring now to FIGS. 3 and 4, it will be apparent that the base 12 of the support 101 carries a central post 102 whose upright 102*a* is vertically adjustable in the manner described by conventional means which are not part of the invention. Such means can include a rack-and-pinion arrangement, a screw stand or even hydraulic or pneumatic means.

This construction enables the platform 3 to rotate about a vertical axis and the upright 1*a*, e.g. via Lazy Susan bearings or the like. In this embodiment the link is formed by a U-shaped bent bar 13 whose bight 14 is mounted in the pivots 105 through the equivalent to the fixed pivot on the underside of platform 3 previously described. The two shanks 15 of the link 13 are pivotally connected at 107 to a narrower platform 106 as previously described and a similar locking arrangement can be provided to adjust the tilt of this platform 106. In this embodiment, however, the two shanks 15 are connected by a rigid strut 16 which is threaded or provided with a nut engaged by the spindle 8.

In both of these embodiments, the pivot 5 or 105 can of course be applied to other locations of this support, e.g. at post 2, 102 or the upright 2*a*, 102*a* with similar results.

Furthermore, instead of a screw spindle for adjusting the height, other adjusting devices, e.g. a ratchet rod, a rack and gear, a work-screw and eccentric disks or any other conventional height adjusting means can be utilized.

Furthermore, a vertical axis can be provided for the small platform as well to enable it to be rotated about this vertical axis and hence positioned at any desired orientation with respect to the main platform 3, 103.

The link 4 can be angled or bent to have an offset end allowing the plate 6 or 106 to rise above the platform 3 or 103 to enable the adjustment of the distance from the main platform 3, 103 to the auxiliary platform 6, 106. The link 4 or the arms 15 can be so made so as to have adjustable lengths in a telescoping construction.

In FIG. 1A, for example, an arm 4 is shown to define a vertical axis 7' for the platform 6' whereby the platform can be rotated as represented by the arrow B.

Figure 6:
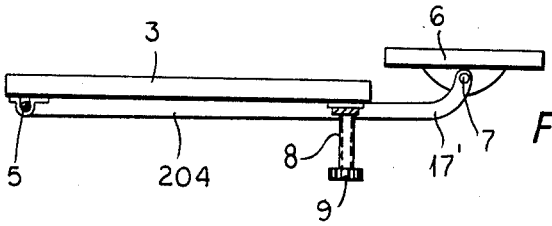
FIG. 6 is a cross section illustrating another embodiment of the connection between a small platform and a large platform according to the invention.
Figure 5:
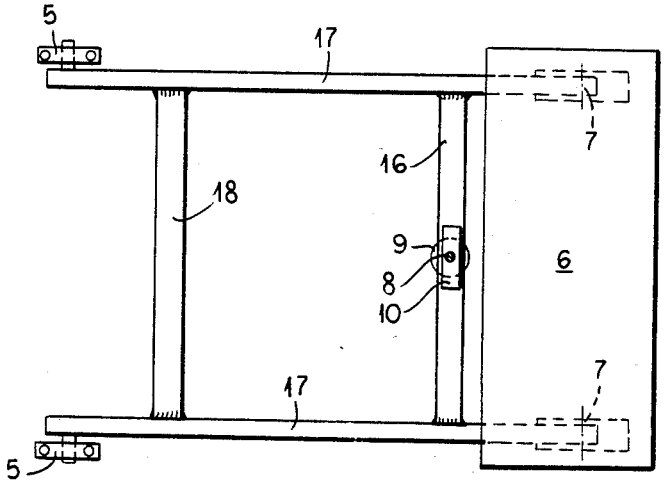
FIG. 5 is a plan view of a special linkage for the second platform in a third embodiment of the invention.

In FIGS. 5 and 6, for example, the shanks 17 of the link 204 are shown to be individual members which are connected in a torsion-stiff relationship by the bars 16 and 18 forming transverse struts. The bars 17, however, are bent upwardly at 17' so that the platform 6 can rise above the platform 3.

Figure 7:
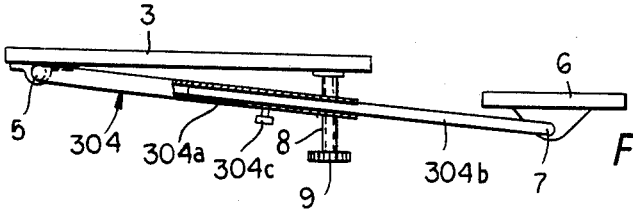
FIG. 7 shows a variant of this construction.

In the embodiment of FIG. 7, the linkage 304*a* comprises a U-shaped tubular member 304*a* whose shanks are extended by bars 304*b* which extend into the respective shanks and can be locked therein by, for example, screws 304*c*. Thus the effective length of the linkages can be adjusted.

In both of these embodiments, of course, the threaded spindle arrangement 8 serves to adjust the angular position of the linkage and hence the height of the platform.

Figure 8:
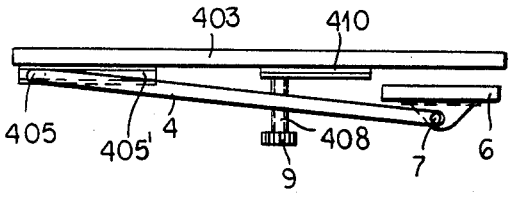
FIGS. 8 through 10 illustrate other embodiments in views similar to FIG. 6.

In the embodiment of FIG. 8, the pivot 405 is shown to be slidable in a guide 405' on the underside of the larger platform 403 while the journaled end of the spindle 408 likewise is slidable can be in horizontal guide 410. This permits the assembly of the arm 4 and the platform 6 to be displaced to the left once the platform is lowered below the level of the platform 403 so that the smaller platform can be stored beneath the larger platform. Once the platform 6 is drawn to the right, it can be received into any desired position in the manner described in connection with FIG. 1.

Figure 9:
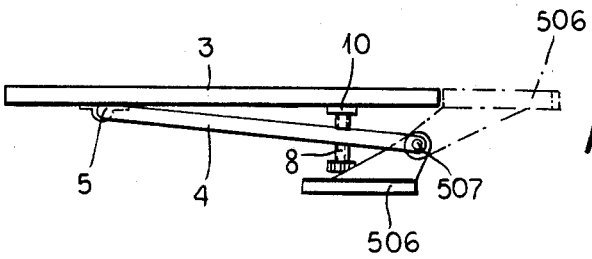

In the embodiment of FIG. 9, the pivot 507 between the link 4 and the platform 506 is offset from a location directly below the platform thereby enabling the platform 506 to be swung from its dot-dash line position into the solid line position shown below the table. The butterfly nut can lock the platform 506 in this latter position.

Figure 10:
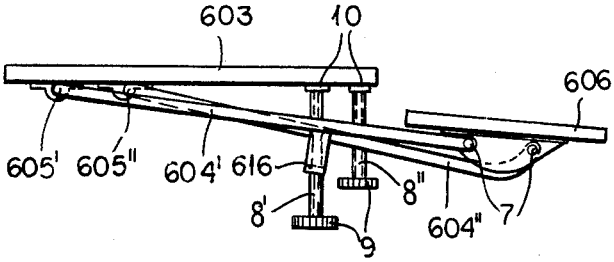

It is also possible as illustrated in FIG. 10 to form a compound linkage which allows both the height and tilt of the platform 606 to be adjusted.

Figure 11:
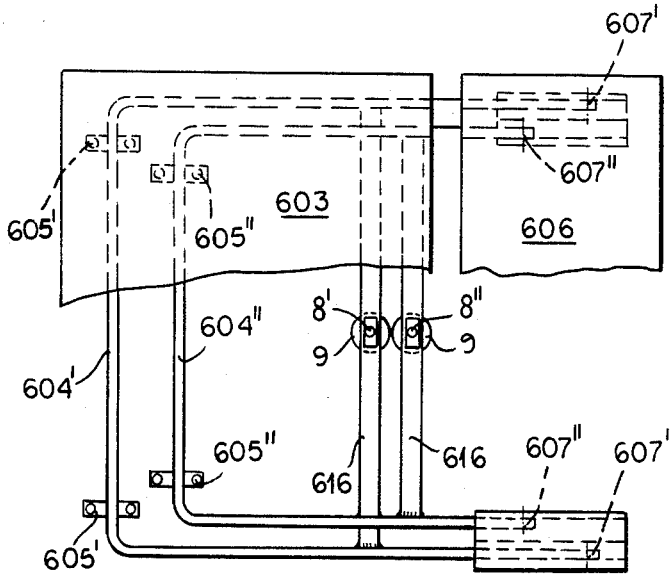
FIG. 11 is a fragmentary plan view corresponding to FIG. 10.

To this end two link members 604' and 604'' forming sort of a parallelogrammatic linkage are individually articulated beneath the platform 603 at respective pivots 605', 605'' and via respective nuts, and spindles 8' and 8'' can be vertically adjusted. In this case, if the links have the U-configuration of FIGS. 3 and 4, for example, the strut 616 can have a trough-like configuration to allow the passage of the link 604'' below the level of the link 604'. The links 604' and 604'' are pivotally connected to the platform 606 at spaced-apart location (see FIG. 11). Consequently, by raising and lowering the link 604'', once the link 604' has been positioned, the tilt of the platform 606 can be adjusted.

Figure 12:
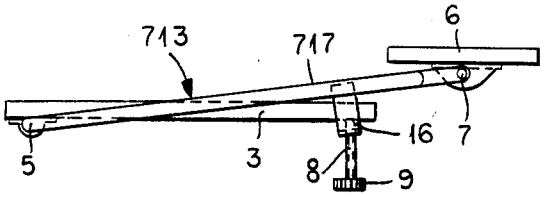
FIG. 12 is another view similar to FIG. 6 but representing still another embodiment.
Figure 13:
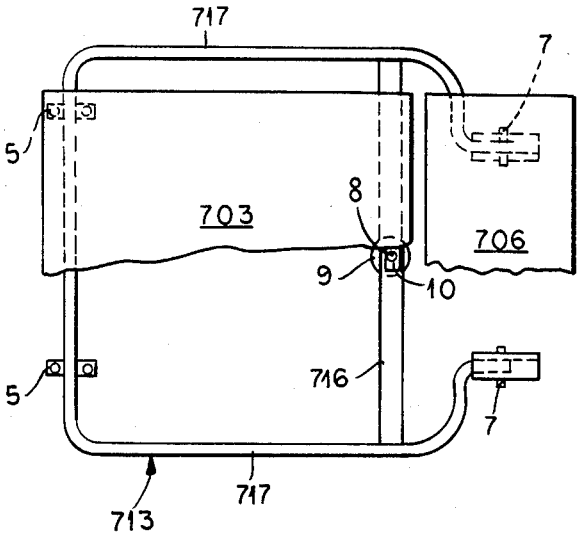
FIG. 13 is a fragmentary plan view associated with this latter embodiment.

From FIGS. 12 and 13, it can be seen that the shanks 717 of link 713 can rise above the platform 703 if they are disposed outwardly thereof and are connected by a trough-shaped strut 716. This allows the platform 706 to be positioned above the platform 703 as well.

Figure 14:
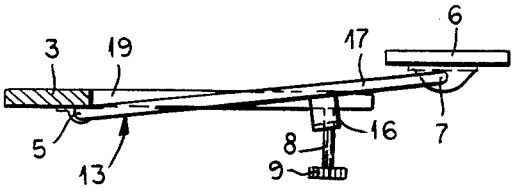
FIG. 14 is a view similar to FIG. 6 showing still another embodiment of this invention.
Figure 15:
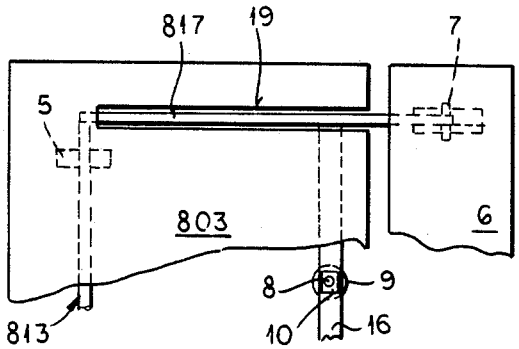
FIG. 15 is a fragmentary plan view corresponding to FIG. 14.

Finally, from FIGS. 14 and 15, it will be apparent that the shanks 817 of the link 813 can rise above the platform 803 if the latter is formed with slots 19 through which these shanks can extend.

Naturally, combinations of the described constructions can also be made within the spirit and scope of this invention.

I claim:

1. A data-processor stand, comprising:

a base;

a vertically adjustable support mounted on said base;

a first generally rectangular platform affixed to said support for receiving a component of a data processor;

an elongated link pivotally connected to said support beneath said first platform at an articulation proximal to one edge of said first platform;

a second platform adapted to receive another component of said data processor and pivotally connected to said link, said link extending beyond an opposite edge of said first platform; and height-adjustment means engaging said link for raising and lowering said second platform relative to said first platform while holding said second platform generally in the region of said opposite edge.

2. The stand defined in claim 1 wherein said height-adjustment means includes a threaded spindle operatively connected to said link.

3. The stand defined in claim 2 wherein said link includes a single arm pivoted at one end to said support beneath said first platform and connected at its opposite end to said second platform.

4. The stand defined in claim 1 wherein said link comprises a U-shaped bent bar having a bight pivotally connected to said support below said first platform and having a pair of shanks pivotally connected at their free ends to said second platform.

5. The stand defined in claim 1 wherein said link comprises a pair of bars each pivotally connected to said support at one end and to said second platform at the opposite end and struts interconnecting said bars in a torsion-resistant structure.

6. The stand defined in claim 1, further comprising means for mounting said second platform on said link for rotation about a vertical axis.

7. The stand defined in claim 1 wherein said link has an upward bent portion adapted to receive said second platform above the level of said first platform.

8. The stand defined in claim 1 wherein said link comprises telescopingly interconnected parts enabling adjustment of a distance between said platforms.

9. The stand defined in claim 1, further comprising guide means for said link below said first platform whereby said second platform can be displaced in a position in which it underlies said first platform.

10. The stand defined in claim 1 wherein said link is pivotally connected to said second platform so as to enable said second platform to be swung beneath said link and said first platform.

11. The stand defined in claim 1 wherein said link includes a pair of link members independently connected pivotally to said support on said second platform for enabling adjustment of the angular orientation of said second platform.

12. The stand defined in claim 11 wherein said members form a generally parallelogrammatic linkage controlling the orientation of said second platform.

13. A data-processor stand, comprising:

a base;

a vertically adjustable support mounted on said base;

a first platform affixed to said support for receiving a component of a data processor;

an elongated link pivotally connected to said support beneath said first platform;

a second platform adapted to receive another component of said data processor and connected to said link; and height-adjustment means engaging said link for raising and lowering said second platform relative to said first platform, said link comprising a U-shaped bent bar having a bight pivotally connected to said support below said first platform and having a pair of shanks pivotally connected at their free ends to said second platform, said shanks lying outwardly of opposite edges of said first platform to enable said second platform to be swung upwardly into a position in which it overlies said first platform.

14. The stand defined in claim 13, further comprising means forming a horizontal pivot between said second platform and said link for enabling the tilting of said second platform about said horizontal axis.

15. A data-processor stand, comprising:

a base;

a vertically adjustable support mounted on said base;

a first platform affixed to said support for receiving a component of a data processor;

an elongated link pivotally connected to said support beneath said first platform;

a second platform adapted to receive another component of said data processor and connected to said link;

height-adjustment means engaging said link for raising and lowering said second platform relative to said first platform; and a slot formed in said first platform to enable said link to pass therethrough and raise said second platform to a level above said first platform.

16. The stand defined in claim 15, further comprising means forming a horizontal pivot between said second platform and said link for enabling the tilting of said second platform about said horizontal axis.

17. A data-processor stand, comprising:

a base;

a vertically adjustable support mounted on said base;

a first platform affixed to said support for receiving a component of a data processor;

an elongated link pivotally connected to said support beneath said first platform;

a second platform adapted to receive another component of said data processor and connected to said link; and height-adjustment means engaging said link for raising and lowering said second platform relative to said first platform, said link comprising a U-shaped bent bar having a bight pivotally connected to said support below said first platform and having a pair of shanks pivotally connected at their free ends to said second platform, said first platform being formed with a pair of slots through which said shanks can pass to raise said second platform to a level above said first platform.

18. The stand defined in claim 17, further comprising means forming a horizontal pivot between said second platform and said link for enabling the tilting of said second platform about said horizontal axis.

* * * * *